US009145717B2

(12) United States Patent
Schuessler et al.

(10) Patent No.: US 9,145,717 B2
(45) Date of Patent: Sep. 29, 2015

(54) LOCKING SYSTEM FOR A MOTOR VEHICLE DOOR

(75) Inventors: Peter Eduard Schuessler, Hoesbach (DE); Mario Tassotto, Darmstadt (DE); Andreas Heberer, Mainz (DE); Oliver Roettel, Buettelborn (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 445 days.

(21) Appl. No.: 13/100,907

(22) Filed: May 4, 2011

(65) Prior Publication Data

US 2011/0285503 A1 Nov. 24, 2011

(30) Foreign Application Priority Data

May 19, 2010 (DE) ..... 20 2010 006 996 U

(51) Int. Cl.

| | |
|---|---|
| ***E05B 85/12*** | (2014.01) |
| *E05B 41/00* | (2006.01) |
| *E05B 77/30* | (2014.01) |
| *E05B 77/54* | (2014.01) |

(52) U.S. Cl.

CPC ..... *E05B 85/12* (2013.01); *E05B 41/00* (2013.01); *E05B 77/30* (2013.01); *E05B 77/54* (2013.01); *E05B 81/77* (2013.01)

(58) Field of Classification Search

USPC ..... 340/5.72, 428, 426.16, 438, 5.7; 70/237–260, 277, 278.1, 278.7, 279.1; 292/336.3, 347

See application file for complete search history.

(56) References Cited

U.S. PATENT DOCUMENTS

| | | | | |
|---|---|---|---|---|
| 5,117,665 | A * | 6/1992 | Swan et al. | 70/264 |
| 6,075,294 | A | 6/2000 | Van den Boom et al. | |
| 6,441,512 | B1 * | 8/2002 | Jakel et al. | 307/10.2 |
| 2003/0122426 | A1 * | 7/2003 | Aiyama et al. | 307/10.1 |
| 2003/0216817 | A1 * | 11/2003 | Pudney | 700/17 |
| 2008/0048827 | A1 * | 2/2008 | Nakasato et al. | 340/5.61 |
| 2009/0133510 | A1 * | 5/2009 | Witte et al. | 73/862.626 |
| 2010/0007463 | A1 * | 1/2010 | Dingman et al. | 340/5.72 |

FOREIGN PATENT DOCUMENTS

| | | | |
|---|---|---|---|
| DE | 19617038 | A1 | 11/1997 |
| DE | 102004061690 | A1 | 7/2006 |
| DE | 102005014581 | A1 | 9/2006 |
| DE | 102009005525 | A1 | 1/2010 |

OTHER PUBLICATIONS

German Patent Office, German Search Report for German Application No. 202010006996.3, dated Aug. 31, 2010.

* cited by examiner

*Primary Examiner* — James Yang
*Assistant Examiner* — Laura Nguyen
(74) *Attorney, Agent, or Firm* — Ingrassia Fisher & Lorenz PC

(57) ABSTRACT

A locking system is provided for a motor vehicle door. The locking system includes, but is not limited to a door lock, an internal actuation unit having a pickup that is mechanically linked to the door lock and alternately transferable into a locked position and an unlocked position. In the locked position, actuation of the pickup is inactive with respect to the lock. The locking system further includes, but is not limited to a detection unit configured to detect an approach of a hand and also configured to unlock the door lock if a distance falls below a predefined distance to the internal actuation unit.

16 Claims, 2 Drawing Sheets

LOCKING SYSTEM FOR A MOTOR VEHICLE DOOR

CROSS-REFERENCE TO RELATED APPLICATION

This application claims priority to German Patent Application No. 202010006996.3, filed May 19, 2010, which is incorporated herein by reference in its entirety.

TECHNICAL FIELD

The technical field relates to a locking system for a motor vehicle door having an internal actuation unit, which is mechanically operationally linked to a door lock, which is alternately transferable into a locked and an unlocked position.

BACKGROUND

Locking systems for motor vehicle doors have, in addition to a door lock, an internal and also an external actuation unit, for example, in the form of door handles or levers, in order to unlock the door lock, on the one hand, and in order to open it, on the other hand. The internal and/or external actuation units, i.e., the door handle modules, are typically connected to the lock via a linkage, in order to transmit an intended movement of the door handle for opening the lock thereto, and in order to transfer a lock-side closing bolt into a release position. Furthermore, the door lock is alternately transferable into a locked position or an unlocked position, for example, a mechanical movement which is transmitted from the door handle via the lock linkage remaining substantially ineffective in the locked position. Converting the movement introduced from the external handle into the lock into opening or release of the lock is only provided in the unlocked state of the lock.

In the locked state of the lock, a direct operational link of a door handle and the closing bolt of the lock is thus interrupted or deactivated. Therefore, in addition to the actual door handle, for example, an exterior lock is to be provided on the vehicle exterior, whose actuation unlocks the actual door lock, so that the vehicle handle can be used for opening the door. Moreover, contactless transmission mechanisms increasingly come into consideration for alternately transferring the door lock into the locked and unlocked positions, such as a radio remote control and also optically and inductively coded transmission systems.

For example, installing at least one electrode in each of the grips of the door handles and attaching a counter electrode in a part of the door opposite to the grip is provided in DE 196 17 038 C2. The approach of a hand of a user can be detected using the electrodes. However, a data request of an operator-side data carrier by an electrical control unit is continuously required for this purpose, in order to only cause unlocking of the lock or locks of a door in case of positive data identification.

In the vehicle interior, the user, typically the driver of the vehicle has the possibility of locking the vehicle door. It can also be provided that the onboard electronics of the vehicle automatically lock all doors of the vehicle above a predefined velocity, for example, above 4 km/h. If a vehicle occupant wishes to exit when the vehicle is at a standstill, he must first cancel out the unlocking, which can be performed by simply pulling on the door internal actuation lever or by actuating a separate grip provided for this purpose, such as a button or bolt situated on the door trim, for example. The previously unlocked door lock and thus the vehicle door can only be opened after a separate unlocking procedure to be initiated by the vehicle occupant, for example, by further actuation of the door internal actuating handle.

In the case of motor vehicles, in particular passenger automobiles, which have vehicle doors in the backseat area which are attached at the rear viewed in the travel direction, i.e., to the C column, it is absolutely necessary to prevent the opening of the vehicle door during travel. This is because otherwise a door which was only opened slightly would result in sudden opening of the vehicle door with support of the travel wind acting in the opening direction of the door, which is absolutely to be avoided solely for reasons of the safety of the vehicle occupants.

Therefore, at least one object is to provide a locking system for a motor vehicle door which is improved with respect to user-friendliness, and which can be implemented in a particularly simple and cost-effective and saving manner, and which offers the highest degree of reliability and occupant protection. In addition, other objects, desirable features and characteristics will become apparent from the subsequent summary and detailed description, and the appended claims, taken in conjunction with the accompanying drawings and this background.

SUMMARY

A locking or closing system is designed for one or more motor vehicle doors, in particular for passenger automobiles. It has an internal actuation unit, which is equipped with a pickup, and which is mechanically operationally linked to a door lock. The door lock is typically situated below a belt line of the vehicle door and is engaged with a lock shackle situated on the vehicle body, preferably on the B or C column, for closing the motor vehicle door.

The door lock, which is typically situated on the door wing, is alternately transferable into a locked and an unlocked position. In the locked position, the lock is inactive with respect to actuation of the pickup which is operationally linked to the lock and it remains in its closed position. However, if the locking is canceled out, and the lock is located in the unlocked position, the movement which is typically introduced into the door lock via a lock linkage is transmitted to the closing bolt, which is operationally linked to the lock shackle, so that it releases the lock shackle, opens the door lock, and allows opening of the door.

Furthermore, the locking system has a detection unit, which is implemented for detecting an approach of a hand of a user and unlocks the door lock if the distance of the hand to the internal actuation unit falls below a predefined distance. The detection unit is thus provided for quasi-automatic unlocking of the door lock. The detection unit recognizes that the user wishes to open the vehicle door merely by the approach of the user hand to the internal actuation unit, in particular to its pickup.

With recognition of the opening wish, the door lock is transferred into its unlocked position, so that the user can open the lock solely by actuating the pickup of the internal actuation unit once. The user-side requirement provided up to this point of unlocking the door lock either manually, for example, by actuating a closure knob, or by repeatedly pulling on the door internal actuation handle is thus completely dispensed with.

The locking system therefore has increased operating comfort. The interior of the vehicle can also be designed much more freely by dispensing with a separate actuation unit provided for the locking and unlocking of the lock.

According to an embodiment, it is particularly provided that the detection unit is implemented for the contactless distance measurement to the internal actuation unit or to its pickup. For this purpose, it is provided in particular that the detection unit has at least one capacitive and/or optical distance sensor. A capacitive distance sensor can have one or more electrodes for this purpose, for example, which may generate a corresponding signal of an approach of a hand because of a dielectric environment which changes in this manner. In addition, it is conceivable that the detection unit is based on solely optical sensors, which may reliably detect an approach measurement to the internal actuation unit by reflection or mere detection of transmitted radiation, for example, in the infrared to UV wavelength range. In addition, linking capacitive and/or solely optical sensors to one another in the detection unit is further conceivable.

According to a further embodiment, the detection unit is mechanically decoupled from the door lock. A connection of detection unit and door lock is preferably implemented solely electronically. The signals provided by the detection unit to a control unit are processed thereby and optionally processed in consideration of further vehicle system or state parameters.

A coupling of detection unit and/or lock preferably occurs exclusively via the control unit, which only relays the signal for door unlocking, which is generated by the detection unit, to the lock if the velocity of the vehicle is below a predefined limiting velocity, i.e., the vehicle velocity represents a further system variable which is decisive for unlocking of the door lock.

In this manner, the unlocking of a door lock and therefore opening of the door can be effectively prevented in the event of a vehicle moving above a predefined limiting velocity. The door lock may thus not be unlocked during the travel of the motor vehicle and the associated door may not be opened. It is particularly provided for this purpose that the door lock automatically locks upon exceeding the predefined limiting velocity.

According to a further embodiment, a motor vehicle door is provided that has an above-described locking system. It is particularly provided that the detection unit of the locking system is situated below a door internal trim, and/or concealed thereby. It is thus not visible to the vehicle occupants. By using door internal trim materials which have a sufficient permeability for the detection mechanism of the detection unit, a configuration of this type of the detection unit provided out of the field of vision of the vehicle occupants can be implemented.

Furthermore, it is advantageous if the detection unit is situated directly adjoining a handle groove provided in the door internal trim, for example, for the pickup of the internal actuation unit. The pickup is advantageously fastened in or on the handle groove, which can in turn be integrated in an armrest of the door internal trim. The approach of a hand of a vehicle occupant to the pickup of the internal actuation unit can be ascertained particularly reliably and precisely by the configuration of the detection unit directly adjoining the handle groove.

On the one hand, a sensor unit which solely determines the distance between sensor and hand of the vehicle occupant can be used for this purpose. Through the least possible distance between sensor unit and pickup of the internal actuation unit, the electrical signals, which can be ascertained by the detection unit and characterize the distance to the approaching hand, may be viewed approximately as the distance between hand and pickup. On the other hand, if detection unit and handle groove are situated directly adjoining one another, comparatively low-power standardized sensor elements, which are cost-effective to purchase, may be used, because in this case only the approach of a hand to the sensor in the immediate sensor environment must be acquired and detected.

According to a further embodiment, a display is provided in or on the handle groove, which is implemented for the purpose of visually indicating an unlocking ability of the door lock, which is a function of the vehicle velocity. For example, the predefined limiting velocity can be in the range around 4 km/h. However, if the vehicle velocity is higher, this can be read off the corresponding display. The display can be implemented as a light-emitting diode, in particular as a monochrome or multicolored LED, in an embodiment.

The unlocking ability of the door lock can be displayed in this case by the display of different colored light spots and by a lighted or extinguished LED. It is preferably provided that the LED illuminates the handle groove at least regionally in a color as soon as the velocity falls below the predefined limiting velocity and the door can be opened by actuating the pickup.

According to an embodiment, the motor vehicle door is implemented so it can be linked so it is pivotable to the rear of the vehicle body viewed in the travel direction of the vehicle. As a door opening to the rear, it is thus preferably to be provided with the locking system, so that opening of the door during travel can be prevented in any case.

According to a further embodiment, a motor vehicle is provided that has at least one above-described motor vehicle door, which is equipped with an above-described locking or closing system. Furthermore, it proves to be particularly advantageous if the locking system is coupled to the rear doors, i.e., the rear doors of the vehicle, in particular of a correspondingly implemented passenger automobile, the rear doors being attached at the rear to the vehicle body viewed in the travel direction of the vehicle, for example, in the area of the C column, and being linked thereon. The rear doors are furthermore exclusively to be transferred into their open position by a pivot movement. The door lock is located in a front wall of the vehicle door pointing toward the travel direction and cooperates with a lock shackle situated on the B column, which is implemented correspondingly thereto.

According to a further embodiment, a method is provided for unlocking a motor vehicle door, which has an internal actuation unit comprising a pickup, which is mechanically operationally linked to a door lock. The door lock is alternately transferable into a locked and an unlocked position, an actuation of the pickup being inactive with respect to the lock in the locked position of the door lock. In this case, the approach of a hand of a user to the pickup is ascertained using a detection unit and if the distance falls below a predefined distance to the internal actuation unit, the door lock is unlocked.

The unlocking method thus provides extensively independent and automated vehicle-side recognition or detection of an opening wish of a vehicle occupant and causes the unlocking of the lock extensively automatically, so that the vehicle occupant can unlock the door lock and open the vehicle door using a single actuation of the pickup of the internal actuation unit of the vehicle door. Furthermore, it has proven to be advantageous for this purpose if the door lock is only unlocked if the vehicle velocity is below a predefined limiting velocity, for example, below approximately 4 km/h.

BRIEF DESCRIPTION OF THE FIGURES

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
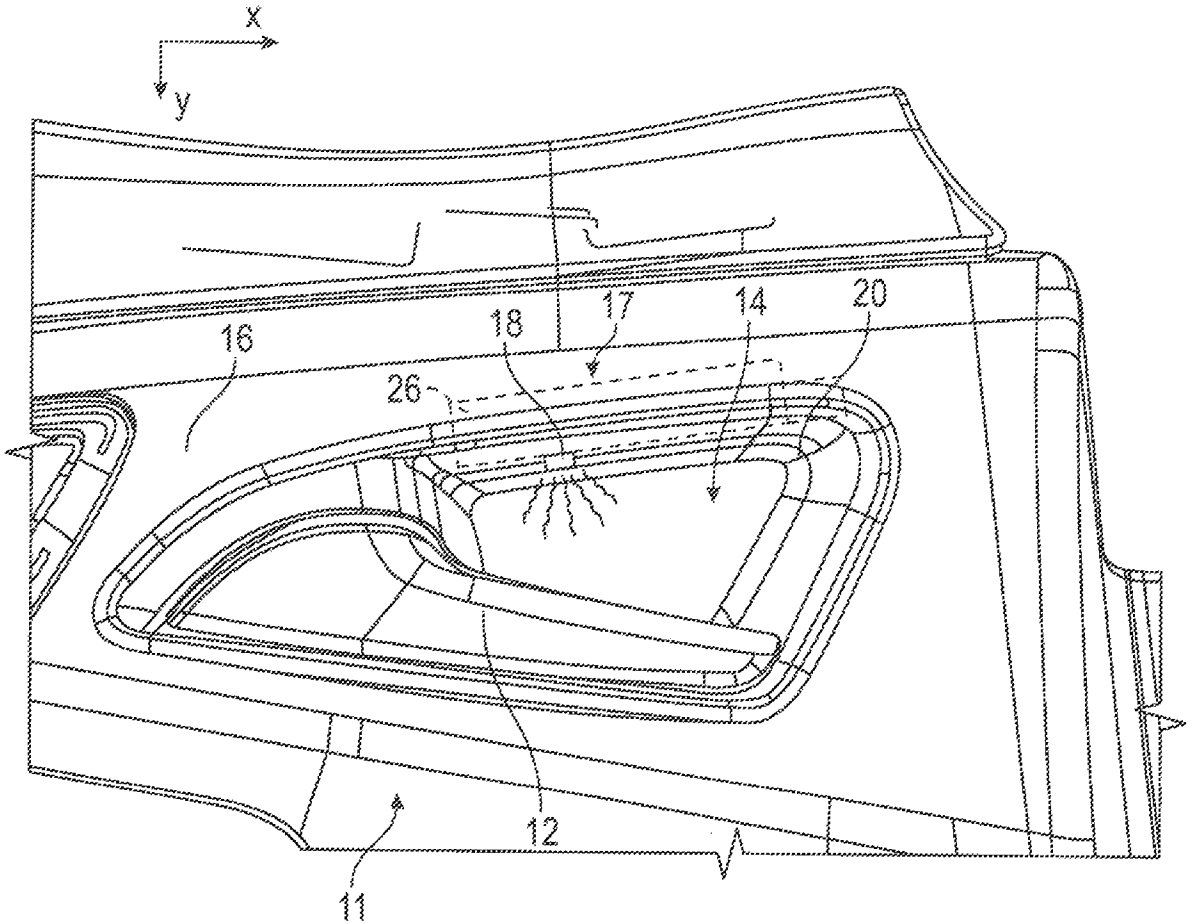
FIG. 1 shows a perspective view of an internal actuation unit of a motor vehicle door viewed from a vehicle occupant.
Figure 2:
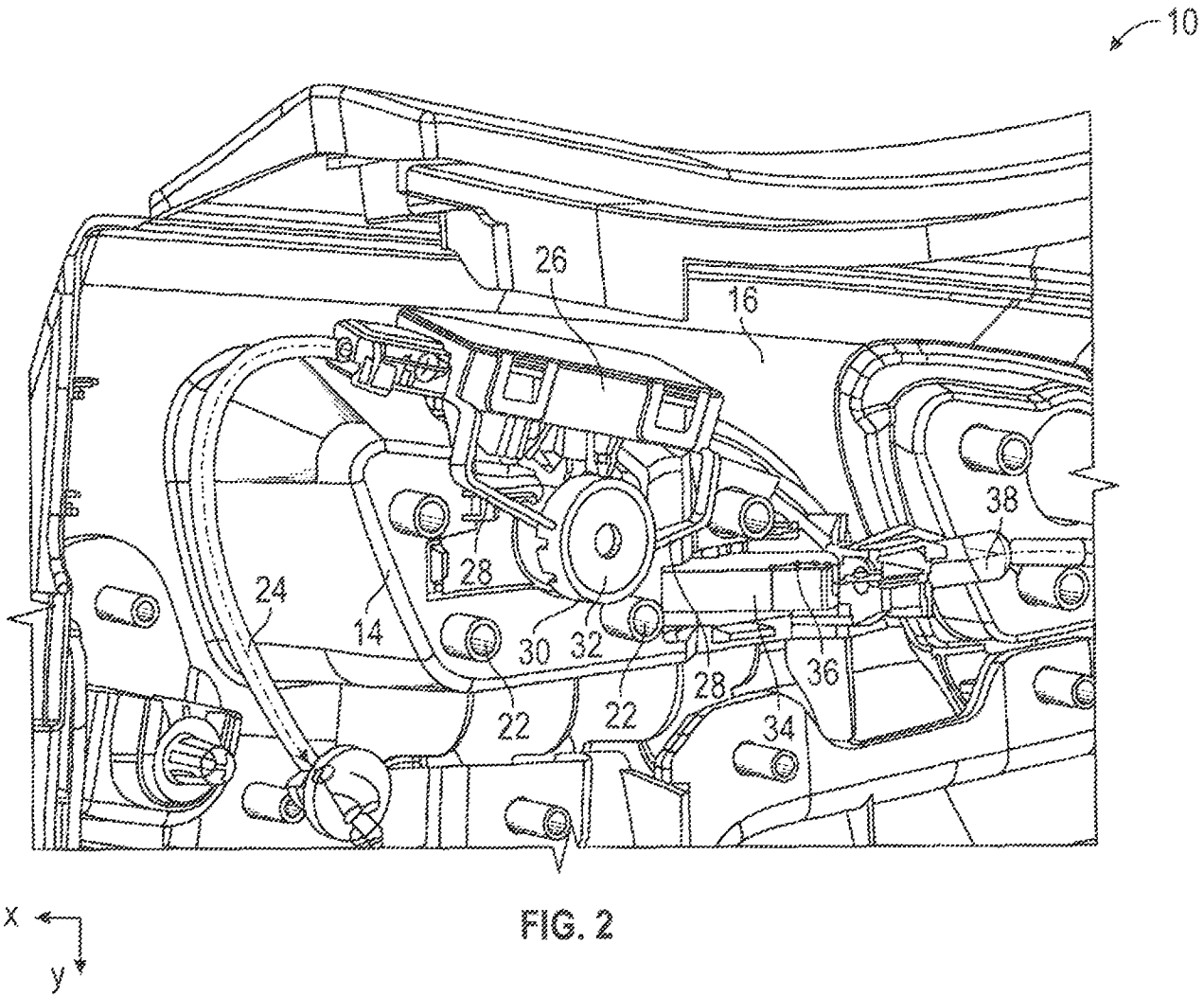
FIG. 2 shows an associated internal view of the internal actuation unit from FIG. 1 viewed from below.

A locking system 10 for a motor vehicle door, in particular for a motor vehicle door which is attached at the rear in the travel direction of the motor vehicle on the C column, is shown in various perspectives in illustrations according to FIG. 1 and FIG. 2. For this purpose, the internal actuation unit 11, which comprises a door internal actuation, handle 12, and which is integrated in modular construction in an armrest of the door internal trim 16, is shown in each case.

A handle groove 14, in which the door internal actuation lever 12, which functions in the present case as the pickup of the modularly implemented internal actuation unit 11, is mounted so it is pivotable, is introduced into the door internal trim section 16, which is shown as plateau-like in FIG. 1 and is implemented as an armrest. In its basic position shown in FIG. 1, the internal actuation lever 12 lies essentially flatly flush in the plane of the door internal trim section 16, which frames or encloses the handle groove 14.

The internal actuation lever 12 is attached in the present exemplary embodiment on the left, i.e., facing away from the travel direction, on the handle groove 14. By pulling up its free end section, which is on the right in FIG. 1, the closing bolt of an unlocked lock (not explicitly shown here) can be transferred into a release position to open the lock and to open the door via mechanical force transmission means. Furthermore, an LED 18 is situated on a cheek 17 of the handle groove 14 opposite to the internal actuation lever 12, which preferably illuminates the handle groove area in color in the present exemplary embodiment as soon as the vehicle velocity is below the predefined limiting velocity, at which opening of the door is made possible.

FIG. 2 shows the internal actuation unit 11 illustrated in FIG. 1 from its bottom side, the area shown on the left in FIG. 2 being in the travel direction (x) of the vehicle. Furthermore, the handle groove 14, which extends opposite to the viewer and is extends from the essentially flat armrest, may be seen here. A lever 34, which is rigidly connected to the internal actuation lever 12 linked to the interior, protrudes laterally to the right from the handle groove 14. A pivot movement of the internal actuation lever 12 initiated by the vehicle occupant accordingly results in a corresponding pivot movement of the lever extension 34, which has a nipple chamber 36 for receiving a cable nipple of an internal pull of an actuating pull 38 on its free end.

With the aid of actuating pull 38, the pivot movement of the internal actuation lever 12 for opening the lock can be transmitted to the lock. However, the lock shackle is only released if the lock (not explicitly shown) is in its unlocked configuration. Otherwise, the pivot movement triggered by the vehicle occupant would be mechanically transmitted to the lock. However, it would be substantially ineffective.

A cylindrical extension 32, which is encompassed by a circular receptacle 30, is implemented on the bottom side of the handle groove 14 shown in FIG. 2. Two connection webs 28 to the housing of a detection unit 26, which is preferably implemented as a capacitive proximity sensor, extend laterally from the receptacle 30. As shown in FIG. 2, the detection unit 26 is located at least partially adjacent to and directly adjoining the handle groove 14. The insertion of one or more fingers into the cavity formed by the handle groove 14 can thus be detected particularly reliably. The detection unit 26 is thus situated on the outer side of a side cheek 17 of the handle groove 14 facing away from the free end of the internal actuation lever 12.

Furthermore, the detection unit 26 is connected via a cable 24 to the control unit (not explicitly shown in the figures), which, in addition to the electrical signals provided by the detection unit 26, at least considers the vehicle velocity before the door lock is transferred into its unlocked position.

Furthermore, a handle groove trim 20 is recognizable in FIG. 1 and FIG. 2, which, depending on the interior design of the vehicle, can be inserted into the handle groove 14, which is always implemented identically independently of the interior design, in various colors and having various surface compositions. The groove trim 20 has multiple connection domes 22 on its bottom side, facing toward the groove bottom, which penetrate groove-side openings corresponding thereto upon reaching their installation position.

Furthermore, the connection domes 22 are designed in this case for the purpose of positively and/or non-positively, in particular welded, to the handle groove 14 by application of thermal or friction energy. The handle groove and also the trim thus preferably comprise a thermoplastic.

The connection of the annular receptacle 30 and the groove-side pedestal is preferably implemented as conical, in order to effectively prevent slipping of receptacle 30 and extension 32 to one another.

The illustrated embodiments only show possible designs, for which numerous further variants are conceivable and within the scope of the invention. The exemplary embodiments shown for exemplary purposes are in no way to be understood as restrictive with respect to the scope, the applicability, or the configuration possibilities. The present summary and description only discloses a possible implementation of an exemplary embodiment to a person skilled in the art. Thus, greatly manifold modifications may be performed on the function and configuration of described elements, without leaving the protective scope defined by the following patent claims or their equivalents.

What is claimed is:

1. A locking system for a motor vehicle door that includes internal trim that includes a handle groove that forms a cavity in the internal trim, the locking system comprising:

a door lock that is alternately transferable into a locked position and an unlocked position;

an internal actuation unit comprising: an internal actuation lever mounted facing the handle groove, wherein the internal actuation lever functions as a pickup that is mechanically linked to the door lock by a mechanical link between the pickup and the door lock, wherein the mechanical link is inactivated when the door lock is in the locked position and is operable when the door lock is in the unlocked position;

a display that is coupled to the handle groove and that is configured to receive the pickup, the display configured to visually indicate an unlocking capability of the door lock as a function of the vehicle velocity, wherein the display comprises: a light emitting diode (LED) situated on a cheek of the handle groove opposite to the internal actuation lever, wherein the LED illuminates an area of the handle groove when a velocity of the motor vehicle is below a predefined limiting velocity, and the door lock is in the locked position and ready to be transferred into the unlocked position, and the sensor has not yet detected insertion of fingers;

a detection unit situated on an outer side of the handle groove such that the detection unit directly adjoins the handle groove and is concealed under the internal trim; and a control unit coupled to the detection unit, wherein the detection unit is solely electronically coupled to the door lock through the control unit, and wherein the detection unit is mechanically decoupled from the door lock, wherein the detection unit is configured to: detect insertion of one or more fingers into the cavity in the internal trim; and generate, when insertion of one or more fingers into the cavity in the internal trim is detected, an unlocking signal, wherein the control unit is configured to: relay the unlocking signal to the door lock to transfer the door lock into the unlocked position only if the velocity of the motor vehicle is below the predefined limiting velocity, wherein the motor vehicle door is capable of being opened when a passenger pulls on the internal actuation lever and when: the door lock is in the unlocked position, the mechanical link is operable, and the velocity of the motor vehicle is below the predefined limiting velocity.

2. The locking system according to claim 1, wherein the detection unit is configured for contactless distance measurement.

3. The locking system according to claim 1, wherein the detection unit comprises a capacitive sensor.

4. The locking system according to claim 1, wherein the detection unit comprises an optical distance sensor.

5. The locking system according to claim 1, wherein the detection unit is configured for mechanically decoupling from the door lock.

6. The locking system according to claim 1, wherein the detection unit is disposed inside a door of the motor vehicle.

7. The locking system according to claim 1, when the door lock is in the unlocked position and the mechanical link, is operable, wherein the internal actuation lever is then operable to displace, via the mechanical link, a closing bolt into a release position to disengage the closing bolt from a lock shackle so that the motor vehicle door can be opened when the internal actuation lever is operated.

8. The locking system according to claim 1, wherein the LED is part of the detection unit and is situated near a hole formed in the cheek of the handle groove so that the LED illuminates the area of the handle groove when the velocity of the motor vehicle is below the predefined limiting velocity.

9. A motor vehicle, comprising:

a door;

a door lock that is alternately transferable into a locked position and an unlocked position;

internal trim of the door;

a handle groove that forms a cavity in the internal trim; and a locking system for locking and unlocking the door, wherein the locking system is internal within the motor vehicle, the locking system comprising:

an internal actuation unit comprising: an internal actuation lever mounted facing the handle groove, wherein the internal actuation lever functions as a pickup that is mechanically linked to the door lock by a mechanical link between the pickup and the door lock, wherein the mechanical link is inactivated when the door lock is in the locked position and is operable when the door lock is in the unlocked position;

a display that is coupled to the handle groove and that is configured to receive the pickup, the display configured to visually indicate an unlocking capability of the door lock as a function of the vehicle velocity, wherein the display comprises: a light emitting diode (LED) situated on a cheek of the handle groove opposite to the internal actuation lever, wherein the LED illuminates an area of the handle groove when a velocity of the motor vehicle is below a predefined limiting velocity, and the door lock is in the locked position and ready to be transferred into the unlocked position, and the sensor has not yet detected insertion of fingers;

a detection unit situated on an outer side of the handle groove such that the detection unit directly adjoins the handle groove and is concealed under the internal trim, wherein at least a portion of the cavity' is situated between the detection unit and the internal actuation lever; and a control unit coupled to the detection unit, wherein the detection unit is solely electronically coupled to the door lock through the control unit, and wherein the detection unit is mechanically decoupled from the door lock, wherein the detection unit is configured to: detect insertion of one or more fingers into the cavity in the internal trim; and generate, when insertion of one or more fingers into the cavity in the internal trim is detected, an unlocking signal;

wherein the control unit is configured to: relay the unlocking signal to the door lock to transfer the door lock into the unlocked position only if the velocity of the motor vehicle is below the predefined limiting velocity, wherein the door is capable of being opened when a passenger pulls on the internal actuation lever and when: the door lock is in the unlocked position, the mechanical link is operable, and the velocity of the motor vehicle is below a predefined limiting velocity.

10. The motor vehicle according to claim 9, wherein the display is an LED display.

11. The motor vehicle according to claim 9, wherein the detection unit is configured for contactless distance measurement.

12. The motor vehicle according to claim 9, wherein the detection unit comprises a capacitive sensor.

13. The motor vehicle according to claim 9, wherein the detection unit comprises an optical distance sensor.

14. The motor vehicle according to claim 9, wherein the detection unit is configured for mechanically decoupling from the door lock.

15. The motor vehicle according claim 9, when the door lock is in the unlocked position and the mechanical link is operable, wherein the internal actuation lever is then operable to displace, via the mechanical link, a closing bolt into a release position to disengage the closing bolt from a lock shackle so that the door can be opened when the internal actuation lever is operated.

16. The motor vehicle according to claim 9, wherein the LED is part of the detection unit and is situated near a hole formed in the cheek of the handle groove so that the LED illuminates the area of the handle groove when the velocity of the motor vehicle is below the predefined limiting velocity.

* * * * *